United States Patent [19]

Wilkins

[11] Patent Number: 4,770,247

[45] Date of Patent: Sep. 13, 1988

[54] SUBSEA RISER FOR MULTIPLE BORE WELLS

[75] Inventor: Robert L. Wilkins, Houston, Tex.

[73] Assignee: Cameron Iron Works USA, Inc., Houston, Tex.

[21] Appl. No.: 47,172

[22] Filed: May 7, 1987

[51] Int. Cl.[4] ..... E21B 7/12

[52] U.S. Cl. ..... 166/341; 166/359

[58] Field of Search ..... 166/341, 345, 359, 366, 166/367

[56] References Cited

U.S. PATENT DOCUMENTS

| | | | |
|---|---|---|---|
| 4,167,215 | 9/1979 | Thorne | 166/341 |
| 4,284,142 | 8/1981 | Kirkland | 166/344 |
| 4,291,724 | 9/1981 | Miller | 137/555 |
| 4,319,637 | 3/1982 | Wilson | 166/340 |
| 4,474,236 | 10/1984 | Kellett | 166/250 |

*Primary Examiner*—Stephen J. Novosad
*Assistant Examiner*—William P. Neuder
*Attorney, Agent, or Firm*—Vinson & Elkins

[57] ABSTRACT

An improved riser for a multiple bore subsea well providing wireline access to each of the bores through a single opening at the upper end of the riser and including an upper tubular member having a single bore, a tubular housing surrounding the lower portion of said upper tubular member, bearing means within said tubular housing for supporting rotation of said upper tubular member with respect to said tubular housing, a lower housing member having multiple bores which mate with the multiple bores of the tubing hanger running tool or the christmas tree running tool, said upper tubular member having an offset portion within said tubular housing which, when rotated can align with the opening of the upper end of the bores through said lower housing member, means securing the lower end of said tubular housing to said lower housing member, a skirt connected to said upper tubular member within said tubular housing and extending into sealing engagement with said lower housing member and being in surrounding relation to said offset portion of said upper tubular member, means for stopping the rotation of said upper tubular member in positions of alignment with the bores of said lower housing member, and means for providing an indication to the upper end of said upper tubular member of the position of the tubular member with respect to said lower housing bores.

10 Claims, 7 Drawing Sheets

SUBSEA RISER FOR MULTIPLE BORE WELLS

BACKGROUND

Multiple bore wells having multibore tubing hangers and christmas trees often utilize multiple tubing strings or "purpose built" multiple bore completion or workover risers. These multiple tubing strings provide access to each individual bore but in deep water locations the multiple tubing strings are cumbersome. Also, the specially built riser to provide access to each individual bore for wirelining is very expensive.

U.S. Pat. Nos. 4,284,142 and 4,474,236 disclose structures of the purpose built type of multiple bore completion/workover risers. These structures provide the multiple bores extending completely through the structure so that access to each bore is available at the water surface.

U.S. Pat. No. 4,291,724 discloses a flowline switching apparatus in which access to a plurality of individual flowlines is provided for through flow line (TFL) tools from a single connection at the top of the structure. This disclosure involves the rotation of a cylinder structure with the flowline extending therethrough being curved to register with the individual bores as the cylinder is rotated.

U.S. Pat. No. 4,319,637 discloses an orienting system for running a multiple string tubing hanger for remote installation, such as an underwater wells.

SUMMARY

The present invention relates to an improved riser for a multiple bore subsea well which provides wireline access to each of the bores through a single opening at the upper end of the riser. The improved riser includes an upper tubular member having a single bore, a lower member having multiple bores which mate with the multiple bores of the tubing hanger running tool or the christmas tree running tool which is located at the subsea wellhead, an intermediate section having a rotary portion with a single bore extending therethrough which communicates with the single upper bore and which will communicate with each one of the lower multiple bores individually as the section is rotated to position the lower end of its bore into communication with the upper end of each of such bores and an external housing surrounding said intermediate section and extending between said upper tubular member and said lower member.

An object of the present invention is to provide an improved, reasonably priced subsea riser which provides communication between a single string at the upper end of the riser with individual strings at the lower end of the riser.

Another object is to provide an improved subsea riser which allows independent and separate operations through the riser with each of the multiple bores to which the riser connects.

A further object is to provide an improved subsea riser through which a single bore extends together with the control lines to control the subsea equipment to which the riser connects.

Still another object is to provide an improved subsea riser connecting a single upper bore to multiple lower bores with a housing structural member which can be used as a pressure vessel and protects the control lines and the rotary portion of the riser.

BRIEF DESCRIPTION OF THE DRAWINGS

These and other objects and advantages are hereinafter set forth and explained with reference to the drawings wherein.

DESCRIPTION OF THE PREFERRED EMBODIMENT

Figure 1:
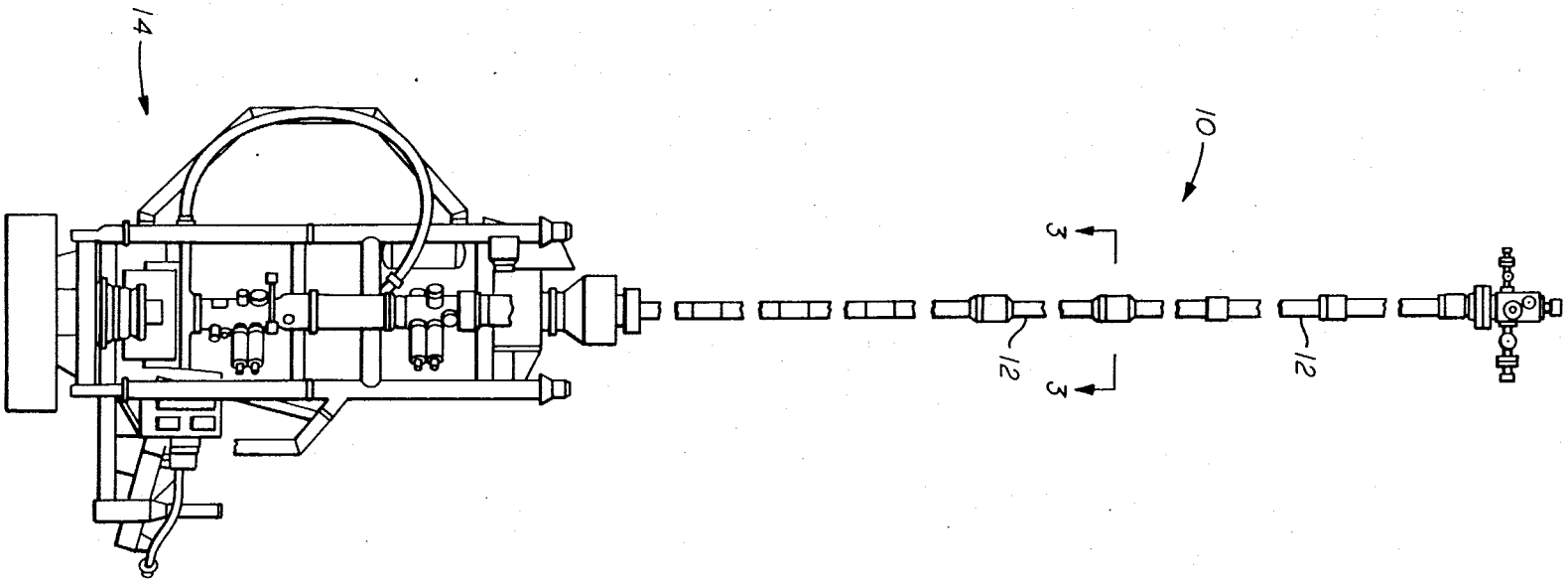
FIG. 1 (PRIOR ART)
FIG. 1 is an elevation view of completion riser of the prior art.
Figure 2:
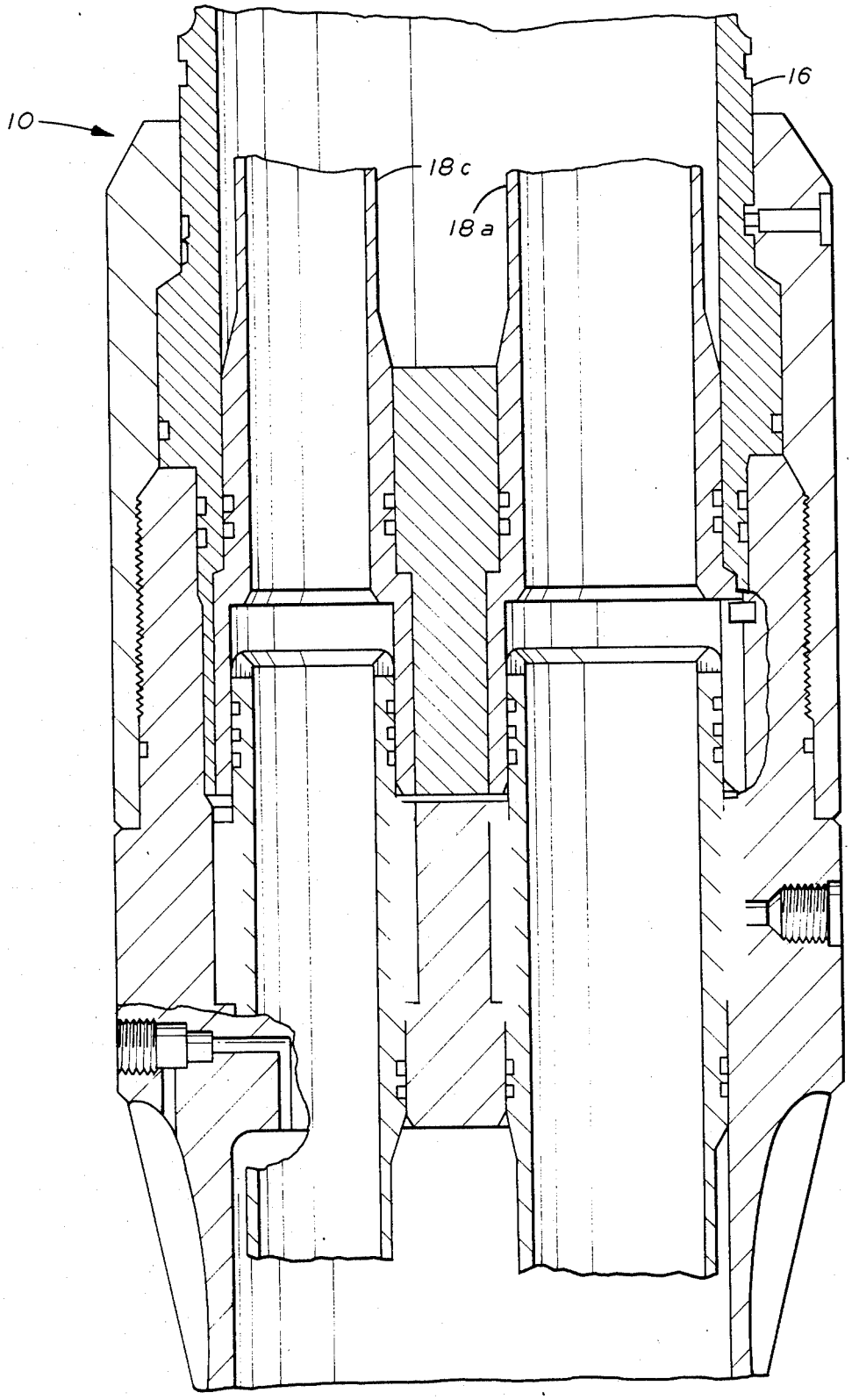
FIG. 2 (PRIOR ART)
FIG. 2 is detail partial longitudinal sectional view of the completion riser shown in FIG. 1.
Figure 3:
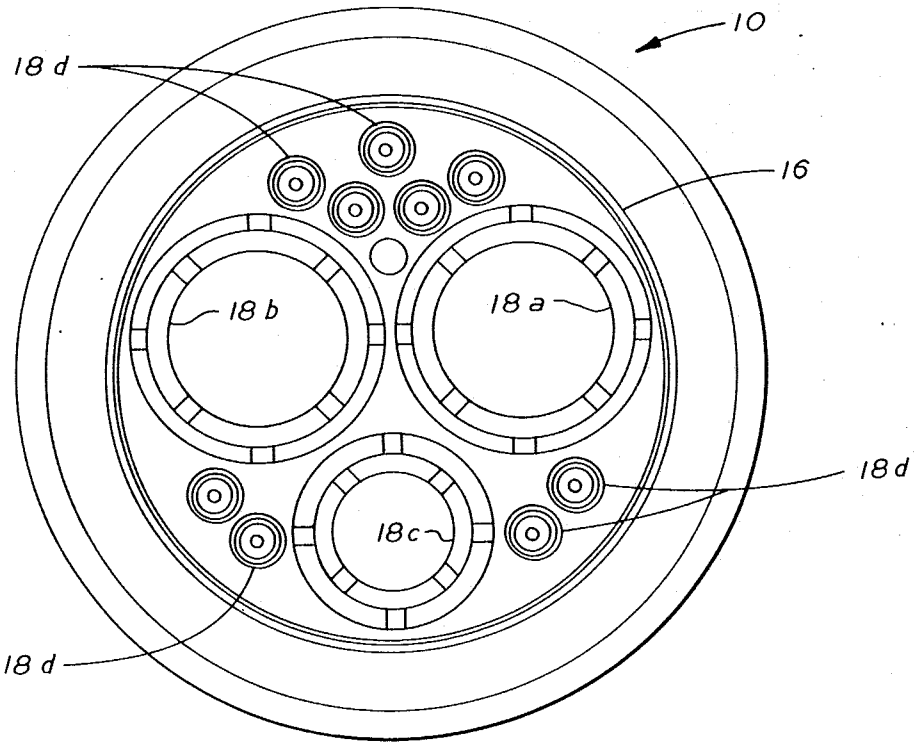
FIG. 3 (PRIOR ART)
FIG. 3 is a sectional view taken along line 3—3 in FIG. 1.

Riser 10 illustrated in FIGS. 1, 2 and 3 discloses the completion riser described above in which riser 10 includes a plurality of sections 12 which are connected end to end to provide connection from the water surface to a subsea wellhead 14. Each of sections 12 includes an outer tubular housing 16 and a plurality of strings 18 which provide the connection from the surface to the subsea wellhead 14. As best seen from FIG. 3, riser 10 includes two strings **18*a* and 18*b* of large diameter one string 18*c* having a slightly smaller diameter and a plurality of strings or control lines 18*d* which extending through tubular housings 16 and are interconnected so that each string 18 and control line 18*d* extends continuously from the upper end to the lower end of riser 10. This structure provides direct access through the two large diameter strings 18*a* and 18*b* to the tubing strings (not shown) within the wellhead 14 for wireline and other operations necessary for completion and workover operations. Each of sections 12 is a complete assembly including all of the tubular members therein to form the complete strings 18**. Such structure is expensive and cumbersome.

Improved riser 20 of the present invention is shown in FIGS. 4 through 7. Riser 20 includes a plurality of sections 22 so that it extends from the surface to the subsea wellhead 24. Riser 20 is different from the risers of the prior art in that the upper of sections 22 include single tubular members 26 extending from the water surface to a point near subsea wellhead 24 with control lines 72 being on the exterior of tubular member 26 and preferably suitably attached or secured to member 26 in a well known manner so that they are not damaged by the currents. The lowest section 22 of tubular member 26 is connected to the upper end of riser selector 28. The function of riser selector 28 is to provide ready access to the interior of each of the well tubing strings within wellhead 24 from tubular member 26 for completion and workover operations.

Riser selector 28 includes upper tubular member 30 having suitable means (threaded box) for connecting to the lower end of the lower tubular member 26, housing 32 surrounding all but the upper portion of upper tubular member 30, bearing means 34 between the upper end of housing 32 and tubular member 26, means 36 secured to the lower end of housing 32 and having means 38 for connecting to the subsea wellhead 24, means 40 for limiting the amount of relative rotation of tubular member 30 with respect to housing 32 and means 42 for providing an indication of the relative position of tubular member 30 with respect to housing 32 and connecting means 38. It should be noted that the improved riser 20 can be run with a christmas tree or a tubing hanger running tool on its lower end.

Upper tubular member 30 includes upper external partial groove 44 which is positioned within flange 46 forming the upper end of housing 32, lower groove 48 in which split ring 50 is positioned to support flange 46 at the preselected level on tubular member 30, upwardly facing bearing shoulder 52, tubing extension 54 and skirt 56 both of which extend from the lower portion of annular ring 58 which forms shoulder 52. Flange 46 is secured to bearing ring 60 having inner lip 62 and with upper thrust bearing 64 positioned between upper shoulder 66 on lip 62 and the lower surface of split ring 50 and lower thrust bearing 68 positioned between lower shoulder 70 on lip 62 and bearing shoulder 52. Tubing extension 54 at its upper end is centered with respect to housing 32 and includes offset portion 54*a* in which tubing extension is gradually bent outward and then returned to a vertical position. This offset portion 54*a* of tubing extension 54 should be at least ten feet long and is preferred to be thirty feet long so that the bends therein are smooth transitions and allow TFL tools to pass therethrough. Control lines 72 connect through flange 46 into bearing ring 60 in positions communicating with passages 74 therethrough and lines 76 connect into the opposite end of passages 74 and extending downwardly within housing 32 in surrounding relation to skirt 56 to connect into housing ring or member 78 to communicate with passages 80 which extend through housing ring 78 and communicate with their mating passages (not shown) in the wellhead equipment connected to the lower end of riser selector 20.

Figure 5A:
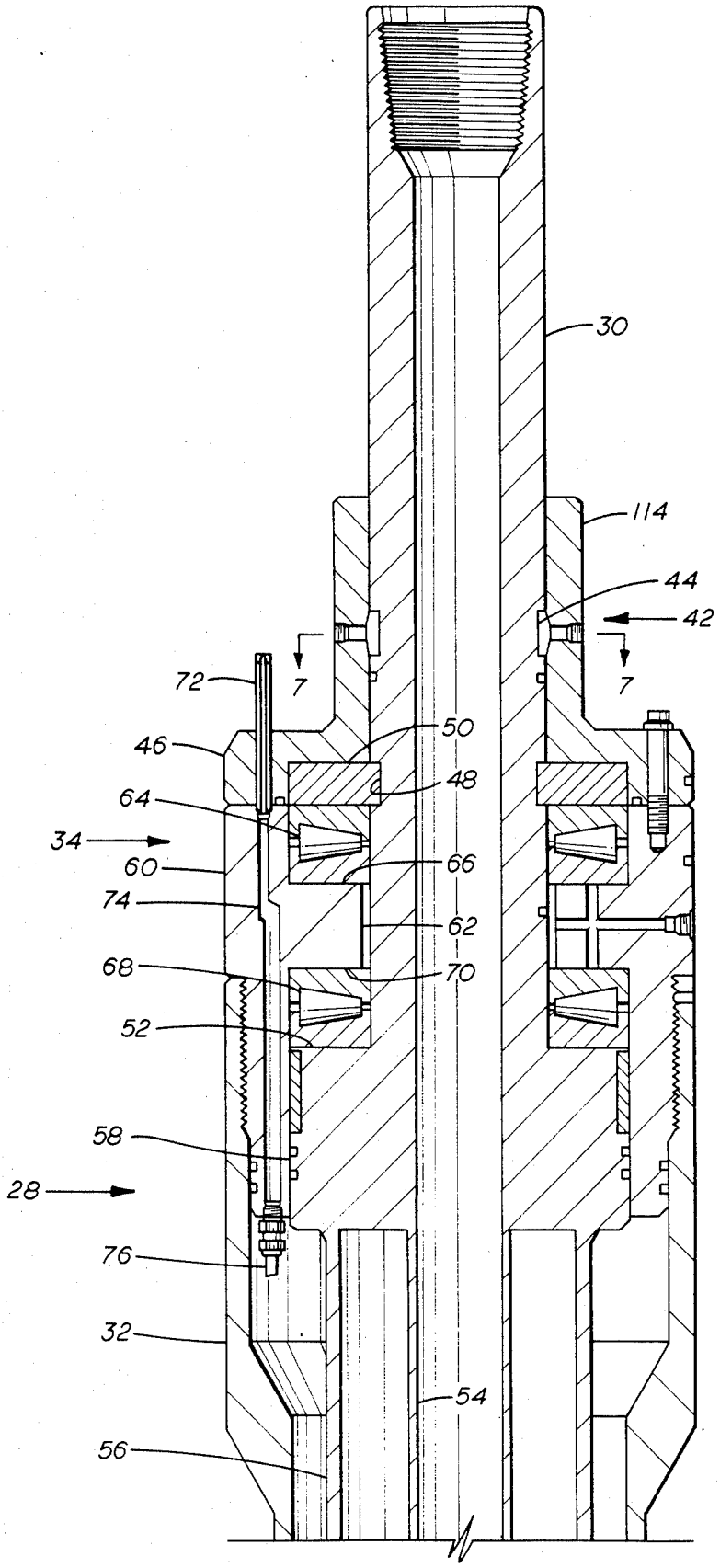
FIG. 5 is a detailed longitudinal sectional view of the lower part of the riser shown in FIG. 4 and includes FIG. 5A which shows the upper portion of the riser selector, 5B which shows the intermediate or offset portion of the riser selector and 5C which shows the lower portion of the riser selector.
Figure 5C:
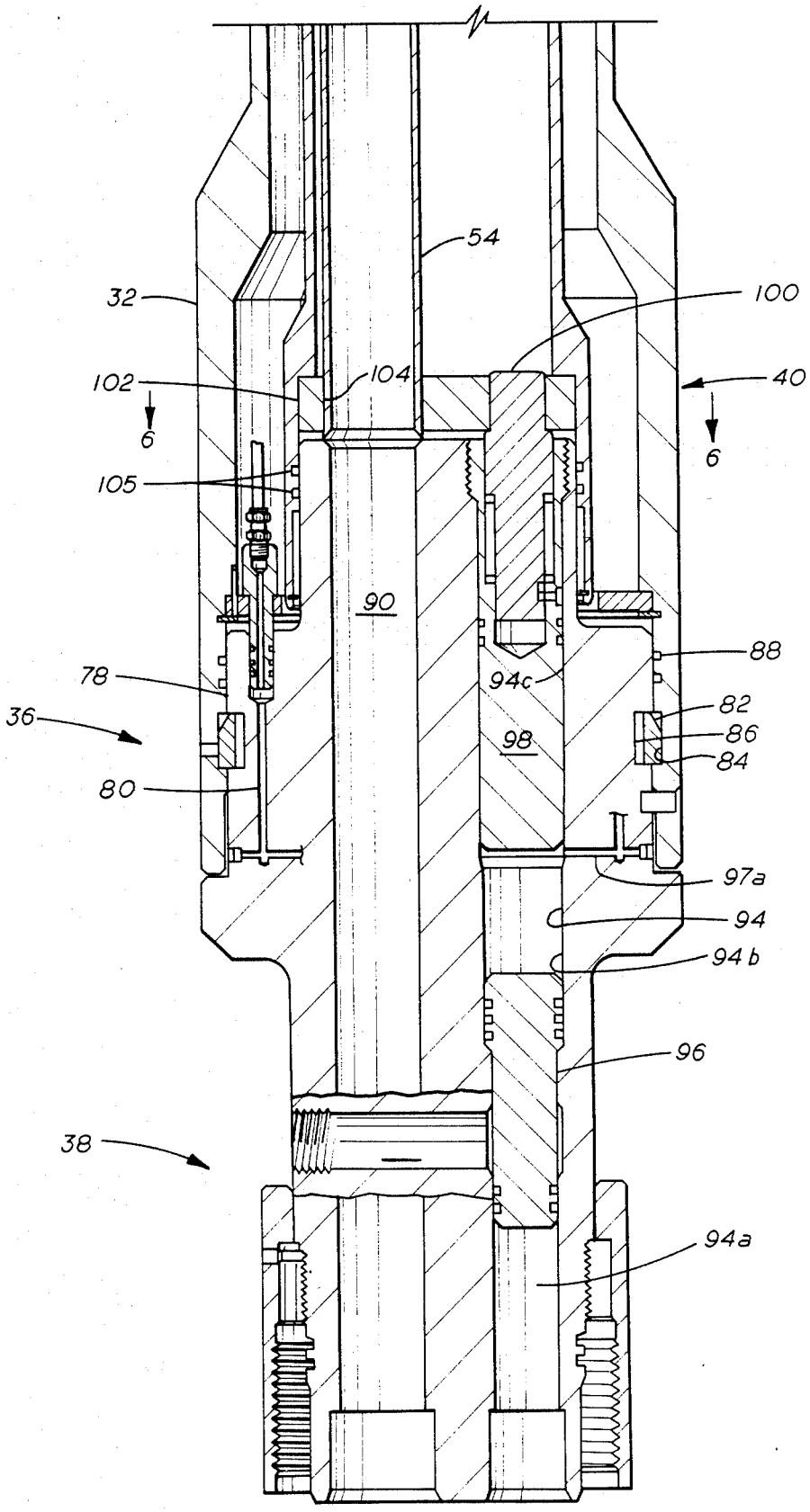
Figure 5B:
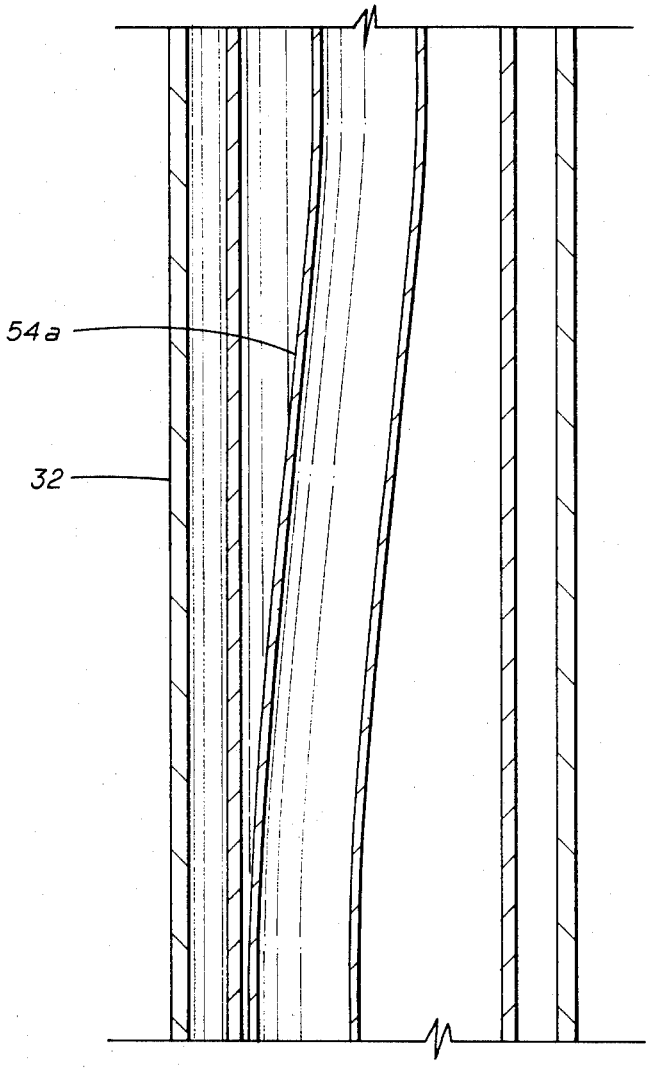

Housing 32 is threaded onto the exterior of bearing ring 60 at its upper end and is sealed around the upper end of housing ring 78 at its lower end. Snap ring 82 by being in engagement with internal groove 84 in housing 32 and external groove 86 in housing ring 78 retains housing 32 secured to housing ring 78. O-rings 88 positioned within grooves on the interior of housing 32 above groove 84 provide sealing between the interior of housing 32 and the exterior of housing ring 78. Bores 90 and 92 extend through housing ring 78 and communicate with the bore of tubing hangers in the wellhead at their lower ends and terminate at the upper end of housing ring 78 as shown in FIG. 5C. Bore 94 also extends through housing ring 78 and provides communication with the annulus around tubing strings within the wellhead. Plug 96 is positioned with its smaller lower end within bore 94*a* and has its upper end which is of a larger diameter within bore 94*b*. Suitable sealing is provided between the exterior of plug 96 and the interior of bores 94*a* and 94*b*. Side passage 97 extends through housing ring 78 into communication with bore 94*a* above the lower seals around the exterior of plug 96 and thus by movement of plug 96 upward can be in communication through bore 94*a* with the annulus below lower housing 78. Passage 97*a* through housing 78 communicates with bore 94*b* above plug 96 and is used to move plug 96 downward into position closing communication between side passage 97 and the lower end of bore 94*a*. Upper plug 98 is positioned within bore 94*c* at the upper end of bore 94 and includes spring loaded detent 100 contained therein and projecting upwardly therefrom as shown and hereinafter described.

Figure 6:
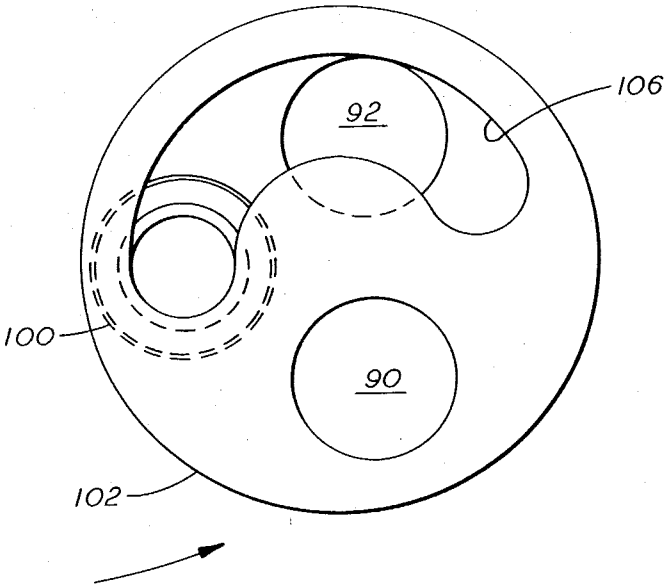
FIG. 6 is a transverse sectional view taken along line 6—6 in FIG. 5 to show the rotational stop structure.
Figure 4:
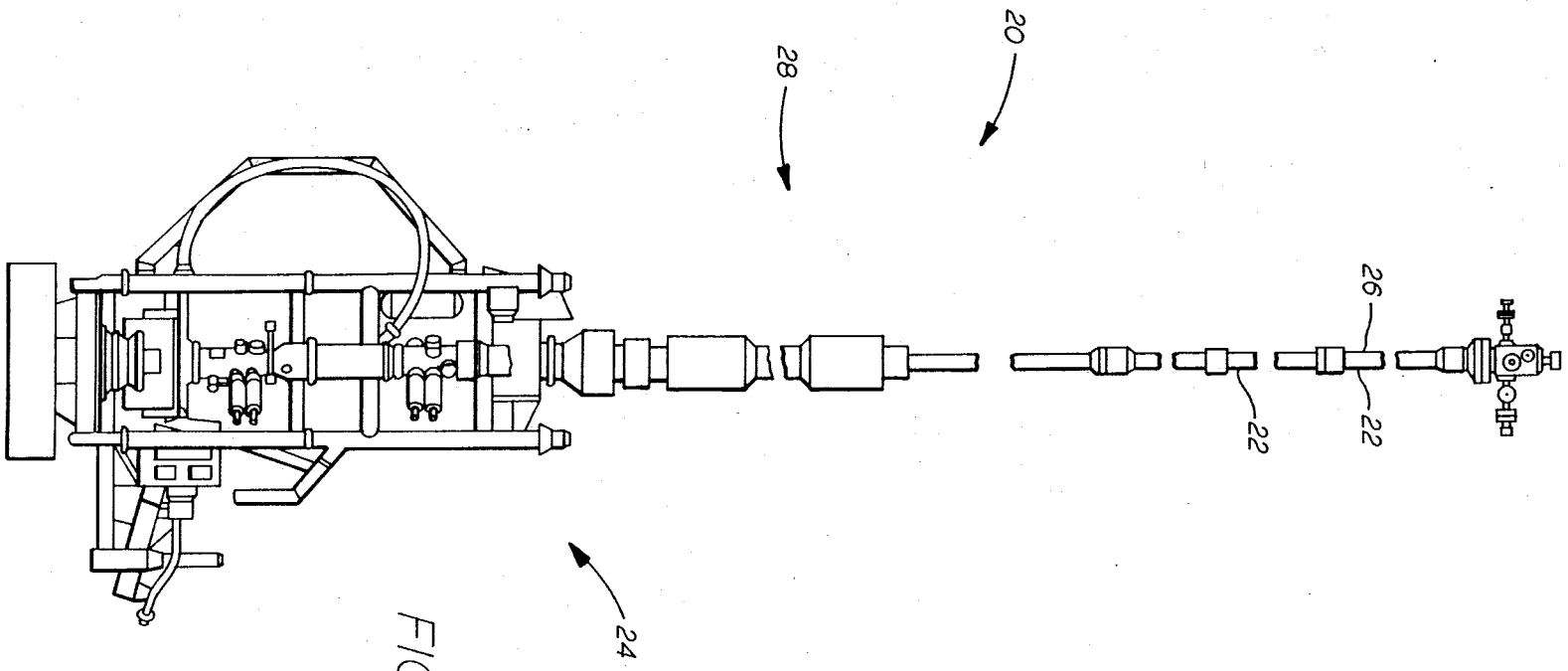
FIG. 4 is an elevation view of the improved riser of the present invention.

As described above, tubular extension 54, as best seen in FIG. 5B, is curved from its upper position within the center of housing 32 to its offset lower position which is in alignment with either bore 90 or bore 92, depending on the rotation of upper tubular member 30 with respect to housing 32. As shown in FIGS. 5C and 6, plate 102 is positioned above housing ring 78 within skirt 56 and the lower end of tubular extension 54 extends through opening 104 in plate 102. Skirt 56 surrounds the upper exterior of lower housing 78 and O-rings 105 provide completely sealed and will retain pressure which is exerted therein. Arcuate slot 106 also extends through plate 102 and the upper end of spring loaded detent 100 extends through slot 106 to limit the rotary movement of tubular member 26 and tubular extension 54 to positions in axial alignment with bores 90 and 92. Connecting means 38 is any suitable connecting means to provide the connection of the lower end of riser selector 20 to the upper end of the christmas tree or tubing hanger running tool (not shown in FIG. 5C).

Figure 7:
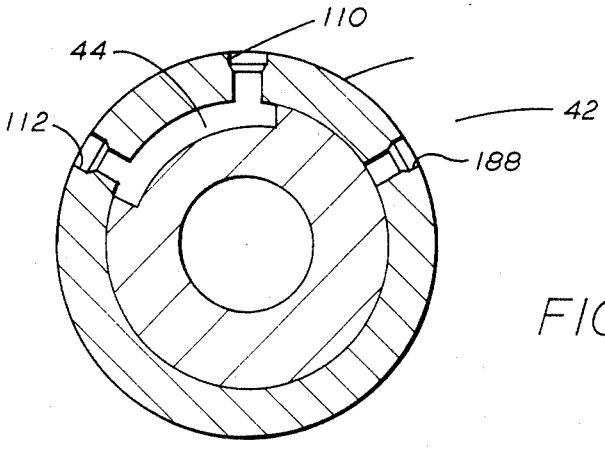
FIG. 7 is another transverse sectional view taken along line 7—7 in FIG. 5 to illustrate the structure of the position indicating apparatus.

Position indicating means 42 is best seen in FIG. 7 and includes ports 108, 110 and 112 extending through neck 114 of flange 46 and port 110 is always in communication with partial annular groove 44 while ports 108 and 112 are alternately in communication with partial groove 110 depending upon the rotation of upper tubular member 26. By supplying hydraulic fluid to port 110 and connecting ports 108 and 112 to indicating devices sensing pressure of hydraulic fluid at each of the alternate ports, an indication of the position of tubular extension 54 with respect to bores 90 and 92 is provided.

It should be noted that by limiting the length of offset portion 54*a* of tubular extension 54, the length of riser selector 28 is limited and the major portion of riser 20 is composed of sections of single bore tubular members. This greatly reduces the cost of the riser but does not interfere with the access to the subsea wellhead for completion or workover operations and is not nearly as cumbersome as the risers of the prior art.

What is claimed is:

1. A subsea riser for connecting to a multiple bore subsea wellhead comprising a tubular housing having an upper end and a lower end, an upper tubular member having an upper end and a lower end, means for rotationally mounting the lower end of said upper tubular member within the upper end of said tubular housing, a lower housing member having multiple bores therethrough spaced around the center of said lower member, and means securing said lower housing member to the lower end of said tubular housing, said upper tubular member having an offset portion; within said tubular housing and a skirt within said tubular housing, surrounding said offset portion and having its lower end in sealing engagement with said lower housing member, the offset portion of said upper tubular member extending within said housing and having its lower ends at a diameter to register with the bores of said lower member as said upper tubular member is rotated within said housing.

2. A subsea riser according to claim 1 including means limiting the extent of rotation of said upper tubular member with respect to said lower housing member.

3. A subsea riser according to claim 2 wherein said lower housing includes two bores extending therethrough and said rotation limiting means includes a plate mounted within said housing immediately above said lower housing member and having an opening therethrough for receiving the lower end of said offset portion of said upper tubular member and an arcuate slot, detent means supported by said lower housing member and extending into said arcuate slot, said arcuate slot being positioned to cause said plate to stop rotation of said tubular member when the lower offset end thereof is in registry with one of the two bores in said lower housing member.

4. A subsea riser according to claim 1 including control lines extending into the interior of said tubular housing at its upper end and exiting therefrom at its lower end, said control lines being position within the annular space between the interior of said tubular housing and the exterior of said skirt so that they do not interfere with the rotation of said upper tubular member and are not damaged thereby.

5. A subsea riser according to claim 1 wherein the offset portion of said upper tubular member is a gradual transition extending a substantial distance along said tubular member within said tubular housing.

6. A subsea riser according to claim 5 wherein the length of said offset portion of said upper tubular member is at least ten feet in length.

7. A subsea riser according to claim 5 wherein the length of said offset portion of said upper tubular member is approximately thirty feet.

8. A subsea riser according to claim 1 including means associated with said tubular housing for indicating the relative rotary position of said tubular member with respect to said tubular housing.

9. A subsea riser according to claim 8 wherein said indicating means includes a flange secured to said tubular housing and having a neck surrounding said tubular member, a partial annular groove in the exterior of said tubular member within said flange neck, a plurality of ports extending through said flange neck at a level to communicate with said partial annular groove with at least one of said ports supplying hydraulic fluid under pressure to said groove and the other of said ports when in communication with said groove delivering hydraulic fluid to the surface to indicate the rotary position of the tubular member within said tubular housing.

10. A subsea riser comprising a plurality of tubular members extending substantially all of the distance to a subsea wellhead, and a riser selector connected to the lower of said tubular members and having means for alternately communicating from said tubular members to one of a plurality of bores within said subsea wellhead, said riser selector being only sufficiently long so that the passage of communication therethrough is a smooth uniform passage allowing direct access to the wellhead bores for both completion and workover operations.

* * * * *